United States Patent [19]

Lee

[11] Patent Number: 4,792,367

[45] Date of Patent: Dec. 20, 1988

[54] IRON-RARE EARTH-BORON PERMANENT

[75] Inventor: Robert W. Lee, Troy, Mich.

[73] Assignee: General Motors Corporation, Detroit, Mich.

[21] Appl. No.: 840,011

[22] Filed: Mar. 17, 1986

Related U.S. Application Data

[63] Continuation-in-part of Ser. No. 520,170, Aug. 4, 1983, abandoned.

[51] Int. Cl.[4] ..... H01F 1/00

[52] U.S. Cl. ..... 148/104; 419/12; 419/23

[58] Field of Search ..... 148/104, 101, 103, 105, 148/120; 419/12, 48, 10, 23, 31, 33, 49, 50

[56] References Cited

U.S. PATENT DOCUMENTS

| | | | |
|---|---|---|---|
| 3,676,610 | 7/1972 | Moss et al. | 148/104 |
| 3,977,918 | 8/1976 | Paladino et al. | 148/104 |
| 4,023,991 | 5/1977 | Kubo et al. | 148/120 |
| 4,358,419 | 11/1982 | Byrne et al. | 264/111 |
| 4,402,770 | 9/1983 | Koon | 148/31.57 |

FOREIGN PATENT DOCUMENTS

| | | | |
|---|---|---|---|
| 101552 | 2/1984 | European Pat. Off. . | |
| 0108474 | 5/1984 | European Pat. Off. . | |
| 56-47538 | 4/1981 | Japan | 75/123 E |
| 57-141901 | 9/1982 | Japan . | |
| 58-123853 | 7/1983 | Japan | 148/101 |
| 60-162750 | 8/1985 | Japan . | |
| W083/00167 | 1/1983 | PCT Int'l Appl. . | |
| 420695 | 9/1974 | U.S.S.R. | 148/101 |
| 1365717 | 9/1974 | United Kingdom . | |

OTHER PUBLICATIONS

Koon et al, Magnetic Properties of Amerphous and Crystallized $(Fe_{0.82}B_{0.18})_{0.9}$ $Tb_{0.05}$ $La_{0.05}$, Appl. Phys. Lett. vol. 39, no. 15, Nov. 15, 1981 pp. 840–842.

A Dictionary of Metallergy, 1958 pp. 256–257.

Sagawa et al., "New Material for Permanent Magnets on a Base of Nd and Fe," J. Appl. Phys. 55(6), 15 Mar. 1984, pp. 2083–2086 paper given Nov. 8–11, 1983.

Kabacoff et al. Thermal and Magnetic Properties of Amorphous $Pr_x(Fe_{0.8}B_{0.2})_{-x}$, J. Appl. Phys., 53(3), Mar. 1982 pp. 2255–2257 paper given at conference Nov. 10–13, 1981.

Hadjipanayis et al., "Investigation of Crystalline Iron Platinum Nichol and Amorphous Rare Earth Iron Alloy for Permanent Magnets," Office of Naval Research, Dept. of Navy, Contract No. N00014-8-1-C-0752, Mar. 15, 1983.

Becker, "Surface Effects on Hysteresis Loop Shapes in High-Coercive-Force Crystallized Amorphous Alloys," IEEE Transactions on Magnetics, Vol. Mag-18, No. 6, Nov. 1982, pp. 1451–1452.

Koon et al, "Composition Dependence of the Coercive Force and Microstructure of Crystallized Amorphous $(Fe_xB_{1-x})_{0.9}Tb_{0.5}La_{0.05}$ Alloys," IEEE Transactions on Magnetics, Vol. Mag-18, No.6, Nov. 1982, pp. 1448–1450.

*Primary Examiner*—John P. Sheehan

*Attorney, Agent, or Firm*—George A. Grove

[57] ABSTRACT

High energy product, magnetically anisotropic permanent magnets are produced by hot working overquenched or fine grained, melt-spun materials comprising iron, neodymium and/or praseodymium, and boron to produce a fully densified, fine grained body that has undergone plastic flow.

7 Claims, 3 Drawing Sheets

IRON-RARE EARTH-BORON PERMANENT

This is a continuation-in-part of my co-pending application Ser. No. 520,170 filed Aug. 4, 1983, now abandoned.

This invention relates to high temperature strain-anneal processing of extremely rapidly solidified compositions comprising iron, one or more rare earth metals, and boron to produce useful permanent magnets. More particularly, this invention relates to the hot consolidation and hot working of overquenched compositions comprising iron, neodymium and/or praseodymium, and boron to form useful, magnetically aligned permanent magnets.

BACKGROUND

High energy product, high coercivity permanent magnet compositions comprising, for example, iron, neodymium and/or praseodymium, and boron and methods of making them are disclosed in U.S. Ser. Nos. 414,936 filed Sept. 3, 1982, 508,266 filed June 24, 1983, now abandoned and 544,728 filed Oct. 26, 1983, all by John J. Croat and assigned to the assignee of this application. An illustrative composition, expressed in atomic proportions, is $Nd_{0.13}(Fe_{0.95}B_{0.05})_{0.87}$. It is substantially the composition of a specific stable intermetallic phase that possesses high coercivity when formed as fine crystallites about 20 to 400 or 500 nanometers in largest dimension.

As disclosed in said U.S. Ser. No. 544,728, which is incorporated herein by reference, the essential and predominant (but not the sole) constituent of such permanent magnet compositions is a tetragonal crystal phase exemplified by the atomic formula $Nd_2Fe_{14}B_1$. The length of the crystallographic c-axis of the tetragonal crystal is about 12.18 Angstroms, and the length of the a-axis is about 8.78 Angstroms. The phase can be identified more generally by the atomic formula $(RE_{1-a}RE'_a)_2(Fe_{1-b}TM_b)_{14}B_1$ where RE is neodymium and/or praseodymium; RE' is one or more rare earth elements taken from the group consisting of yttrium, lanthanum, cerium, samarium, europium, gadolinium, terbium, dysprosium, holmium, erbium, thulium, ytterbium and lutetium; and TM is one or more transition metal elements taken from the group consisting of cobalt, nickel, manganese, chromium and copper; and a is from about 0 to 0.4 and b is from about 0 to 0.4.

Melts of the above family of compositions can be very rapidly quenched, such as by melt spinning, to produce a solid material, e.g., a thin ribbon. When the rate of cooling hasbbeen controlled to produce a suitable fine crystalline microstructure (20 nm to 400 or 500 nm,, the material has excellent permanent magnet properties. On the other hand, faster cooling (overquenching) produce a material with smaller crystallites and lower coercivity. However, as disclosed, such overquenched material can be annealed to form the suitable crystal size with the associated high coercivity and high energy product.

An interesting and useful property of this neodymium-iron-boron material (for example) is that it is magnetically isotropic. A fine grain, melt-spun ribbon can be broken up into flat particles. The particles can be pressed i a die at room temperature to form a unitary body of about 85 percent of the material's density Bonding agents can be employed before or after the compaction. The making of such bonded magnets is disclosed in U.S. Ser. No. 492,629, filed May 9, 1983, (now abandoned) by Robert W. Lee and John J. Croat and assigned to the assignee hereof. It was surprising to find that such bonded magnets displayed no preferred magnetic direction. Values of intrinsic coercivity or maximum energy product were not dependent upon the direction of the applied magnetic field. There was no advantage in grinding the ribbon to very fine particles and magnetically aligning the particles before compaction.

Such magnetically isotropic materials are very useful because they can be easily pressed (without magnetic alignment) into bonded shapes. The shapes can be magnetized in the most convenient direction.

It is recognized that the iron-neodymium-boron type compositions might provide still higher energy products if at least a portion of the grains or crystallites in their microstructure could be physically aligned and if such alignment produced at least partial magnetic domain alignment. The material would then have a preferred direction of magnetization. The material would be magnetically anisotropic and would have higher residual magnetizatio and higher energy product in the preferred direction. I have now accomplished this using overquenched-melt-spun material by hot working the material to consolidate it to full density and to effect plastic flow that yields magnetic alignment. The same improvement can be accomplished on finely crystalline, high coercivity material (e.g., $H_{ci} > 1000$ Oe) if the hot work is performed before excessive grain growth occurs and coercivity decreases.

It is an object of my invention to provide a fully densified fine grain, anisotropic, permanent magnet formed by hot working a suitable material comprising iron, neodymium and/o praseodymium, and boron. This anisotropic magnet has higher residual magnetization and energy product than isotropic magnets of like composition.

It is an object of my invention to provide a method of treating overquenched compositions containing suitable proportions of iron, neodymium and/or praseodymium, and boron at suitable temperatures and pressures to fully densify the material into a solid mass, to effect the growth of fine, high coercivity crystallites add to cause a flow and orientation of the material sufficient to produce macroscopic magnetic alignment.

It is another object of my invention to treat suitable transition metal-rare earth metal-boron compositions that do not have peraanent magnet properties because their microstructure is amorphous or too finely crystalline. The treatment is by a hot working process, such as hot pressing, hot die upsetting, extrusion, forging, rolling or the like, to fully consolidate pieces of the material, to effect suitable grain growth and to produce a plastic flow therein that results in a body having magnetic alignment. It is found that the maximum magnetic properties in such a hot worked body are oriented parallel to the direction of pressing (perpendicular to the direction of flow). In the direction of preferred magnetic alignment, energy products are obtainable that are significantly greater than those in isotropic magnets of like composition.

It is also to be recognized that hot pressing for the purpose of consolidation to full density is beneficial even without substantial magnetic alignment.

BRIEF SUMMARY

In accordance with a preferred embodiment of my invention, these and other objects and advantages are accomplished as follows:

A molten composition comprising iron, neodymium and/or praseodymium, and boron is prepared. Other constituents may be present, as will be disclosed below. An example of a preferred composition, expressed in terms of atomic proportions, is $Nd_{0.13}(Fe_{0.95}B_{0.05})_{0.87}$. The molten material is cooled extremely rapidly, as by melt spinning, to oorm a thin ribbon of solid material that does not have permanent magnet properties. Typically, the material is amorphous in microstructure. It will not produce an x-ray pattern containing many discrete diffraction maxima like that obtained from diffraction in crystalline substances. When highly magnified, as in a scanning electron microscope micrograph, no discrete grains (or crystallites) will be apparent.

The ribbon or other thin, solid form may be broken, if necessary, into particles of convenient size for an intended hot working operation. The particles are heated under argon to a suitable elevated temperature, preferably 700° C. or higher, and subjected to short term hot working under pressure, preferably at least 10,000 psi. Such processing may be accomplished by any of a number of known hot working practices. The material may be hot pressed in a die. It may be extruded, or rolled, or die upset, or hammered. Whatever the particular form of hot working employed, the several individual particles are pressed and flowed together until the mass achieves full density for the composition. In addition, the hot mass is caused to undergo plastic flow. During the exposure at high temperature, the nonpermanent magnet microstructure is converted to a suitable fine grain crystalline material. The flow of the hot, fine grain material produces a body that, upon cooling below its Curie temperature, has preferred direction of magnetization and provides excellent permanent magnet properties. The predominant constituent of the fine grain material is the tetragonal crystal structure phase described in U.S. Ser. No. 544,728 and exemplified by the atomic formula $RE_2TM_{14}B_1$ wherein RE is one or more rare earth elements and wherein neodymium and/or praseodymium comprise at least about 60 percent of the total rare earth elements, and TM is one or more transition metal elements where iron comprises at least about 60 percent of the total transition metal elements.

As suitably practiced, the high temperature working produces a finely crystalline or granular microstructure (for example, up to about 0.4 to 0.5 micrometers in greatest dimension). Care is taken to cool the material before excessive grain growth and loss of coercivity occurs. The preferred direction of magnetization of my hot worked product is typically parallel to the direction of pressing and transverse to the direction of plastic flow. A significantly higher energy product is obtained when the body is magnetized transverse to the direction of plastic flow.

As previously stated, material of like composition and similar microstructure has been made without hot working. Such materials have been magnetically isotropic and had lower maximum energy product.

In another embodiment of my invention, the starting material may be a high coercivity (>1000 Oe) isotropic material. Suitable hot working of the material will fully densify it and effect plastic flow to orient the fine crystallites in a magnetically anisotropic structure. However, the duration of the hot working must be such that the crystallites do not grow so large that the desirable magnetic properties are lost.

An advantage of my process is that magnets can often be hot worked to final shape. Finish quenching or other machining can often be avoided.

These and other objects and advantages of the invention will become more apparent from a detailed description thereof which follows. Reference will be made to the drawings, in which.

Figure 3A:
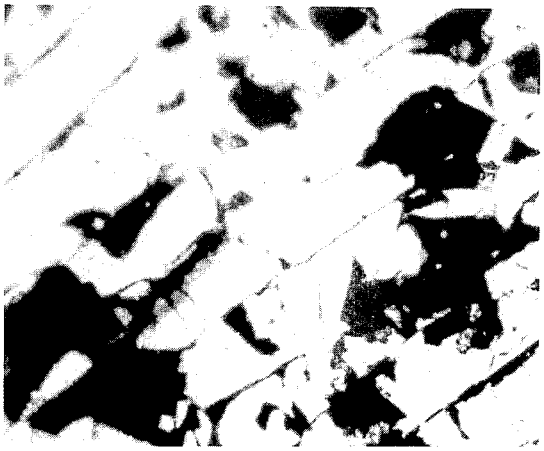
Figure 3B:
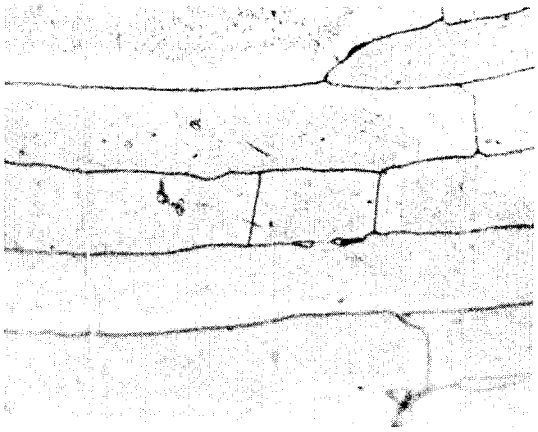
Figure 3C:
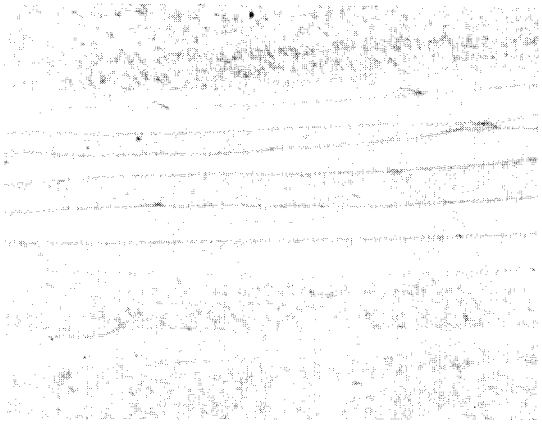
Figure 5:
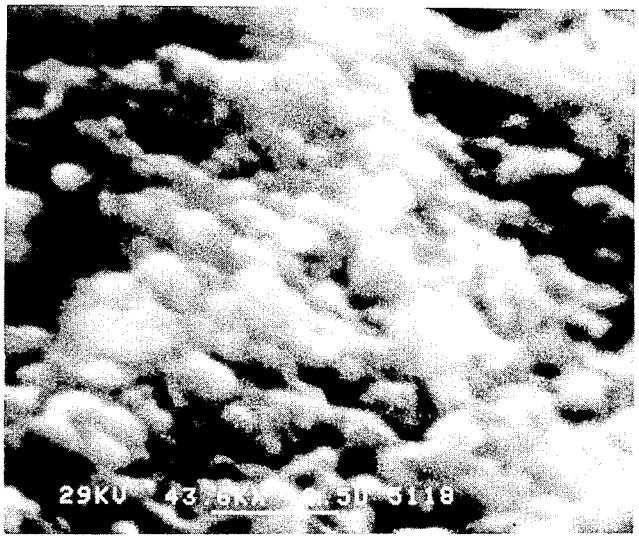
Figure 4:
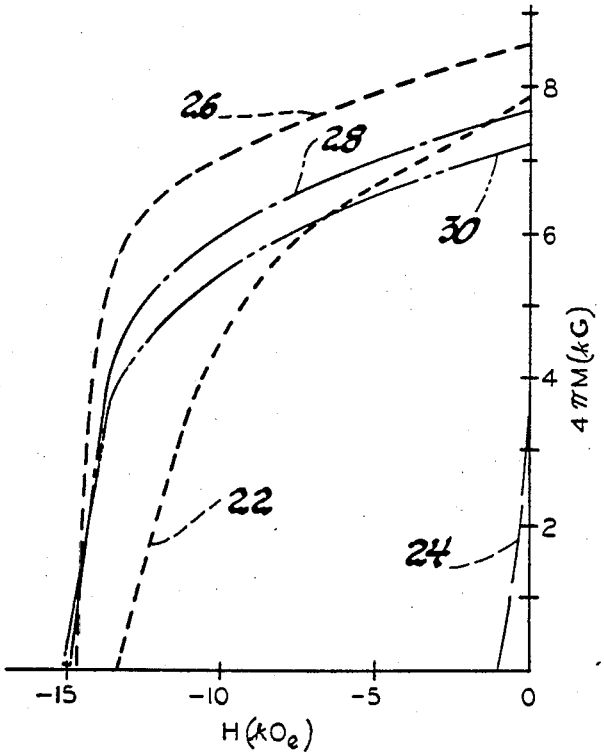
Figure 6:
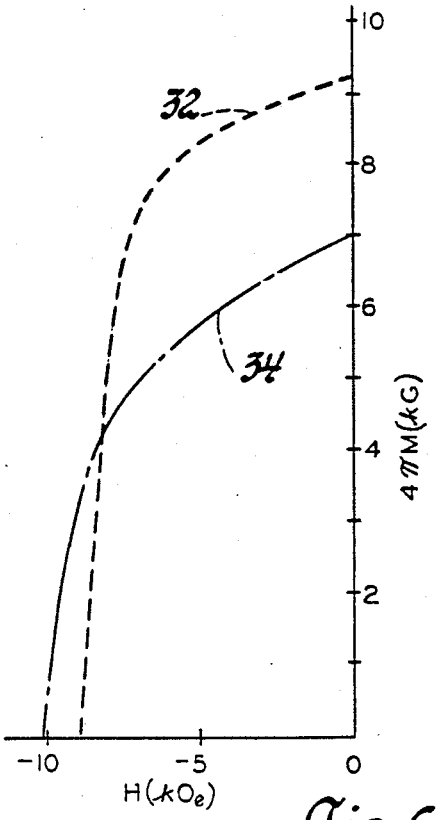
Figure 7:
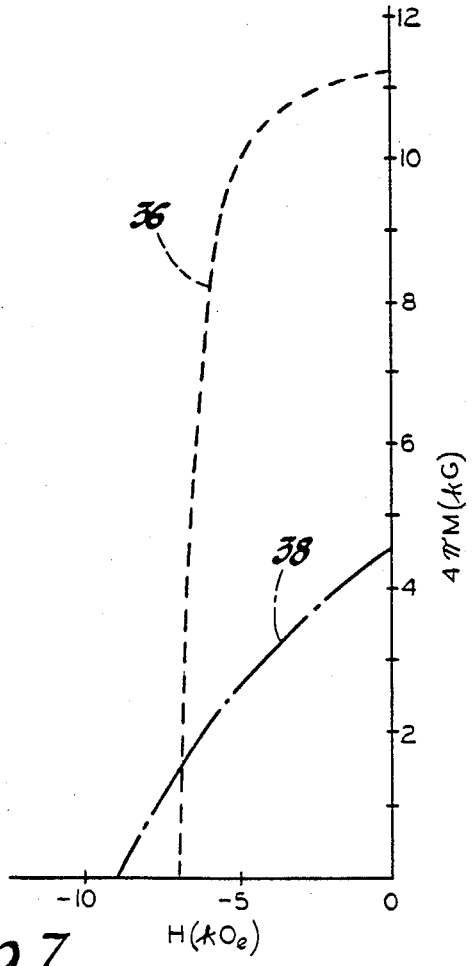

FIG. 3*a* is a photomicrograph at 600× magnification of a sample compacted to 85 percent of theoretical density in accordance with earlier work;

FIG. 3*b* is a photomicrograph at 600× magnification of a sample hot pressed in accordance with my method;

FIG. 3*c* is a photomicrograph a 600× magnification of a sample extruded in accordance with my method;

FIG. 4 is a second quadrant, room temperature, $4\pi M$ versus H plot of a sample produced by extrusion;

FIG. 5 is a Scanning Electron Microscope micrograph at 43,600× magnification, illustrating the texture of the fracture surface of an extruded sample prepared in accordance with my method;

FIG. 6 is a second quadrant, room temperature, $4\pi M$ versus H plot of a sample produced by die upsetting in accordance with my method; and FIG. 7 is a second quadrant, room temperature, $4\pi M$ versus H plot of a sample produced by a different die upsetting practice in accordance with my method.

DETAILED DESCRIPTION

My method is applicable to compositions comprising a suitable transition metal component, a suitable rare earth component, and boron.

The transition metal component is iron or iron and (one or more of) cobalt, nickel, chromium or manganese. Cobalt is interchangeable with iron up to about 40 atomic percent. Chromium, manganese and nickel are interchangeable in lower amounts, preferably less than about 10 atomic percent. Zirconium and/or titanium in small amounts (up to about 2 atomic percent of the iron) can be substituted for iron. Very small amounts of carbon and silicon can be tolerated where low carbon steel is the source of iron for the composition. The composition preferably comprises about 50 atomic percent to about 90 atomic percent transition metal component—largely iron.

The composition also comprises from about 10 atomic percent to about 50 atomic percent rare earth component. Neodymium and/or praseodymium are the essential rare earth constituents. As indicated, they may be used interchangeably. Relatively small amounts of other rare earth elements, such as samarium, lanthanum, cerium, terbium and dysprosium, may be mixed with neodymium and praseodymium without substantial loss of the desirable magnetic properties. Preferably, they make up no more than about 40 atomic percent of the rare earth component. It is expected that there will be small amounts of impurity elements with the rare earth component.

The composition contains at least 1 atomic percent boran and pereferably about 1 to 10 atomic percent boron.

The overall composition may be expressed by the formula $RE_{1-x}(TM_{1-y}B_y)_x$. The rare earth (RE) component makes up 10 to 50 atomic percent of the composition (x=0.5 to 0.9), with at least 60 atomic percent of the rare earth component being neodymium and/or praseodymium. The transition metal (TM) as used herein makes up about 50 to 90 atomic percent of the overall composition, with iron representing about 80 atomic percent of the transition metal content. The other constituents, such as cobalt, nickel, chromium or manganese, are called "transition metals" insofar as the above empirical formula is concerned.

Boron is present in an amount of about 1 to 10 atomic percent (y=about 0.01 to 0.11) of the total composition.

The practice of my invention is applicable to a family of iron-neodymium and/or praseodymium-boron containing compositions which are further characterized by the presence or formation of the tetragonal crystal phase specified above, illustrated by the atomic formula $RE_2TM_{14}B$, as the predominant constituent of the material. In other words, my hot worked permanent magnet product contains at least fifty percent by weight of this tetragonal phase.

For convenience, the compositions have been expressed in terms of atomic proportions. Obviously, these specifications can be readily converted to weight proportions for preparing the composition mixtures.

For purposes of illustration, my invention will be described using compositions of approximately the following atomic proportions:

$$Nd_{0.13}(Fe_{0.95}B_{0.05})_{0.87}$$

However, it is to be understood that my method is applicable to a family of compositions as described above.

Depending on the rate of cooling, molten transition metal-rare earth-boron compositions can be solidified to have microstructures ranging from:

(a) amorphous (glassy) and extremely fine grained microstructures (e.g., less than 20 nanometers in largest dimension) through (b) very fine (micro) grained microstructures (e.g., 20 nm to about 400 or 500 nm) to (c) larger grained microstructures.

Thus far, large grained microstructure melt-spun materials have not been produced with useful permanent magnet properties. Fine grain microstructures, where the grains have a maximum dimension of about 20 to 400 or 500 nanometers, have useful permanent magnet properties. Amorphous materials do not. However, some of the glassy microstructure materials can be annealed to convert them to fine grain permanent magnets having isotropic magnetic properties. My invention is applicable to such overquenched, glassy materials. It is also applicable to "as-quenched" high coercivity, fine grain materials. Care must be taken to avoid excessive time at high temperature to avoid coercivity loss.

Suitable overquenched compositions can be made by melt spinning. In my melt spinning experiments the material is contained in a suitable vessel, such as a quartz crucible. The composition is melted by induction or resistance heating in the crucible under argon. At the botoom of the crucible is provided a small, circular ejection orifice about 500 microns in diameter. Provision is made to close the top of the crucible so that the argon can be pressurized to eject the melt from the vessel in a very fine stream.

The molten stream is directed onto a moving chill surface located about one-quarter inch below the ejection orifice. In examples described herein, the chill surface is a 25 cm diameter, 1.3 cm thick copper wheel. The circumferential surface is chrome plated. The crucible and wheel are contained in a box that is evacuated of air and backfilled with argon. In my experiments, the wheel is not cooled. Its mass is so much greater than the amount of melt impinging on it in any run that its temperature does not appreciably change. When the melt hits the turning wheel, it flattens, almost instantaneously solidifies and is thrown off as a ribbon. The thickness of the ribbon and the rate of cooling are largely determined by the circumferential speed of the wheel. In this work, the speed can be varied to produce an amorphous ribbon, a fine grained ribbon or a large grained ribbon.

In the practice of my method, the cooling rate or speed of the chill wheel preferably is such that an amorphous or extremely fine crystal structure is produced. Such a structure will be amorphous or will have finer crystals than that which produces a permanent magnet as is, for example, less than about 20 nanometers in largest dimension. As a practical matter, the distinction between an amorphous microstructure and such an extremely fine crystalline microstructure is probably not discernible. What is desired is an overquenched material that has less than optimum permanent magnetic properties but that can be annealed to produce improved permanent magnet properties. In accordance with my practice, the material is, in effect, annealed while it is hot worked to produce a magnetic microstructure.

A few examples will further illustrate the practice of my invention.

EXAMPLE 1

An overquenched, melt-spun ribbon was prepared. A molten mixture was prepared in accordance with the following formula: $Nd_{0.13}(Fe_{0.95}B_{0.05})_{0.87}$. About 40 grams of the mixture was melted in a quartz tube that was about 10 cm long and 2.54 cm in diameter. The quartz tube had an ejection orifice in the bottom, which was round and about 600 μm in diameter. The top of the tube was sealed and adapted to supply pressurized argon gas to the tube above the molten alloy. The alloy was actually melted in the tube using induction heating. When the melt was at 1400° C., an argon ejection pressure of about 3 psig was applied.

An extremely fine stream of the molten metal was ejected down onto the rim of the above-described wheel. The wheel was made of copper and the perimeter surface was plated with chromium. The wheel was initially at room temperature and was neither heated nor cooled during the experiment, except from contact with the molten metal ejected onto it. The wheel was rotated at a rim velocity of about 35 meters per second (m/s).

A solidified melt-spun ribbon came off the wheel. It was about 30 μm thick and about one mm wide.

This material was cooled too rapidly to have useful permanent magnet properties. In other words, it was overquenched. Had the wheel been rotated slightly slower, the ribbon could have been produced to have a microstructure affording useful hard magnetic properties (e.g., a coercivity of 1000 Oe or greater).

Figure 1:
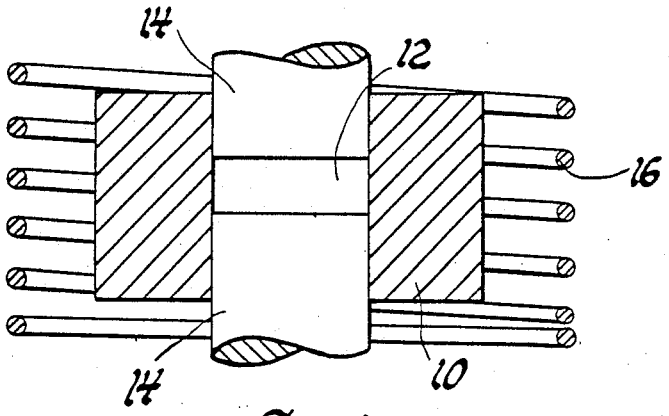
FIG. 1 is a cross-sectional view of a hot pressing die for practicing one embodiment of my invention.

The ribbon was broken into short pieces, and they were placed into the cylindrical cavity 12 of a round die 10 like that depicted in FIG. 1. The cavity was ⅜ inch in diameter and the material was contained by upper and lower punches 14. The die was made of a high temperature nickel alloy with a tool steel liner, and the punches were tungsten carbide.

The die and the contents were rapidly heated under argon with an induction coil 16 to a maximum temperature of 750° C. The temperature was measured using a thermocouple (not shown) in the die adjacent the cavity. The upper punch was then actuated to exert a maximum pressure of 32,000 psi on the broken-up ribbon particles. Heating and pressure were stopped. The workpiece was cooled to room temperature in the die. However, the total time that the workpiece was at a temperature above 700° C. was only about five minutes. The consolidated workpiece was removed from the die. The resulting cylinder was hard and strong. It had a density of about 7.5 grams per cubic centimeter., which is substantially its full density.

The magnetic properties of the material were determined by cutting a piece from the cylinder and grinding a small sphere, about 2 mm in diameter, from the cut off piece. The sphere was magnetized in an arbitrary direction by subjecting it to a pulsed magnetic field having a strength of about 40 kiloGauss. The sphere was then placed in a vibrating sample magnetometer with its pulsed direction aligned with the magnetometer field. The sample was subjected to a gradually decreasing magnetic field from +10 kOe to −20 kOe that produced corresponding decreasing sample magnetization ($4\pi M$). In this manner, the second quadrant demagnetization plot ($4\pi M$ versus H) was obtained for the particular direction of magnetization.

The sample was removed from the magnetometer and magnetized in a pulsed field as before in a different direction. It was returned to the magnetometer and a new demagnetization curve determined. This process was again repeated and the respective curves compared. The sample displayed different magnetic properties in different measurement directions. Therefore, the magnet exhibited a preferred direction of magnetization.

Figure 2:
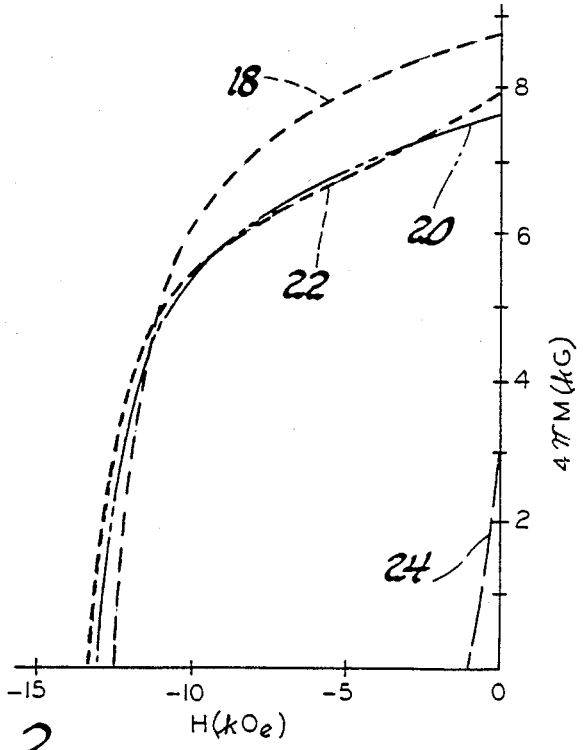
FIG. 2 is a second quadrant, room temperature, $4\pi M$ versus H plot of a sample produced by hot pressing.

FIG. 2 contains four different second quadrant plots of $4\pi M$ versus H. The second quadrant portion of a hysteresis loop provides useful information regarding permanent magnet properties. Three of these plots in FIG. 2 represent good properties. The residual magnetization at zero field (H=0) is high, and the intrinsic coercivity, i.e., the reverse field to demagnetize the sample ($4\pi M=0$), is high. The upper curve 18 represents a favorable direction of magnetization obtained in the spherical sample. The lowest curve 20 represents the data obtained from a direction relatively far removed from the direction corresponding to the direction represented by curve 18. The middle curve 22 is the demagnetization plot also generated in the vibrating sample magnetometer of an isotropic array of an annealed portion of the same ribbons from which this hot compact was made. These annealed ribbon samples were heated at a rate of 160° C. per minute to a temperature of 727° C. and then cooled at the same rate to room temperature. The data obtained was normalized to a sample density of 100 percent. Thus, plot 22 is of an isotropic magnet of the same composition as the anisotropic magnet produced in this example.

A hysteresis curve was also prepared from a sample of the original overquenched ribbon. The second quadrant portion is produced as curve 24 in FIG. 2. It has relatively low intrinsic coercivity and residual magnetization.

Thus, the hot pressing operation produced a fully densified oody and also produced material flow so that the body became magnetically anisotropic. In the preferred direction of magnetization (represented by curve 18), the residual magnetization and energy product are greater than in the isotropic material.

In addition to having excellent permanent properties at room temperature, the hot pressed body retains its properties during exposure at high temperatures in air. A hot pressed body of this example was exposed at 160° C. in air to a reverse field of 4 kOe for 1,507 hours. It suffered only minimal loss in permanent magnet properties.

FIG. 3*a* is a photomicrograph of a cross-section of a bonded magnet that was compacted at room temperature to 85 percent of full density. The large dark regions are voids produced during specimen polishing and are not representative of an unpolished sample. The plate-like sections of the original ribbon are seen to line up and be preserved in the bonded magnet. FIG. 3*b* is a photomicrograph at the same magnification of a hot pressed specimen fully densified in accordance with my invention. The flat ribbon fragments are still perceptible at about the same size as in the bonded magnet, but there are no voids in this fully densified specimen.

EXAMPLE 2

Another overquenched, melt-spun ribbon was prepared by the method described in Example 1. The nominal composition of the ribbon was in accordance with the empirical formula $Nd_{0.13}(Fe_{0.94}B_{0.06})_{0.87}$. The ribbons were produced by quenching the melt on a chill wheel rotating at a velocity of 32 m/s. The thickness of the ribbon was approximately 30 μm and the width approximately one millimeter. This cooling rate produced a microstructure that could not be magnetized to form a magnet having useful permanent magnet properties.

Ribbon pieces were compacted at room temperature in a die to form a precompacted body of about 85 percent full density. The precompact was then placed in the cavity of a high temperature alloy die similar to that described in Example 1. However, the die had a graphite liner. Carbide punches confined the precompact in the die cavity. The die and its contents were quickly heated under argon to 740° C. and a ram pressure of 10 kpsi was applied in an attempt to extrude the preform. An unexpected form of backward extrusion was obtained as the precompacted material flowed out from between the punches and displaced graphite die liner to form a cup-like piece. After cooling to room temperature, this piece was removed from the die and it was found that the extruded portion of the sample was of sufficient dimensions to allow density measurement as well as magnetic measurement. The extruded portion was fully densified.

A 2 mm cube was ground from a portion of the extruded metal, and it was tested in a vibrating sample magnetometer. By magnetizing and demagnetizing the sample transverse to the cube faces, it was observed that the specimen was magnetically anisotropic. Three orthogonal directions are displayed in FIG. 4 by curves 26, 28 and 30. The differences between these second quadrant plots for different directions of magnetization result from physical alignment of magnetic domains within the sample. The greater the separation of the plots, the greater the degree of magnetic alignment. It is seen that the alignment for the extruded sample was even more pronounced than for the sample of FIG. 1. The demagnetization curves for the annealed ribbon 22 and the overquenched ribbon 24 are also included in this figure as in FIG. 2. It is seen that the coercivity of the extruded sample is even higher than that of the annealed ribbons presumably because a more appropriate crystallite size was achieved during the extrusion. The magnetization of the extruded sample in its most preferred direction is higher and results in higher energy product than that obtainable in isotropic annealed ribbons.

FIG. 3*c* is a photomicrograph at 600× magnification of a cross-section of the extruded sample. It is seen that greater plastic flow occurred in the extruded sample as evidenced by the reduction in thickness of the original ribbon particles. It is believed that this plastic flow is essential to alignment of the magnetic moments within the material and that this alignment is generally transverse to the plastic flow. In other words, with respect to this sample, the magnetic alignment is transverse to the long dimension of the extruded ribbons (i.e., up and down in FIG. 3*c*).

FIG. 5 is a scanning electron microscope micrograph at nearly 44,000× magnification of a fracture surface of the extruded sample. It shows the fine grain texture.

Additional hot press tests, like Example 1, and modified extrusion tests, like Example 2, were carried out at various die temperatures in the range of 700° to 770° C. and pressures in the range of 10,000 to 30,000 psi. These tests showed that full densification could be realized even at the lower pressures and temperatures. However, the samples prepared at the lower temperatures and pressures appeared to be more brittle. Optical micrographs revealed the ribbon pieces to have cracks similar to those present in FIG. 3*a*. Evidently, higher pressure is required at temperatures of 750° C. and lower before such cracks disappear as in FIG. 3*b*. The preferred magnetization direction for the hot pressed samples is parallel to the press direction and perpendicular to the direction of plastic flow. Greater directional anisotropy develops when more plastic flow is allowed, as in the extrusion tests.

EXAMPLE 3

This example illustrates a die upsetting practice.

Overquenched ribbon fragments of Example 2 were hot pressed under argon in a heated die, like that in FIG. 1, at a maximum die temperature of 770° C. and pressure of 15 kpsi. A ⅜ inch cylindical body, 100 percent dense, was formed. This hot pressed cylinder was sanded to a smaller cylinder (diameter less than 1 cm) with its cylindrical axis transverse to the axis of the original cylinder. This cylinder was re-hot pressed in the original diameter cavity along its axis (perpendicular to the original press direction) so that it was free to deform to a shorter cylinder of ⅜ inch diameter (i.e., die upsetting). The die upsetting operation was conducted at a maximum temperature of 770° C. and a pressure of 16 kpsi. As in previous examples, the part was cooled in the die. A cubic specimen was machined from the die upset body and its magnetic properties measured parallel and transverse to the press direction in a vibrating sample magnetometer, as in the above Examples 1 and 2. Second quadrant, room temperature $4\pi M$ versus H plots for these two directions are depicted in FIG. 6. Curve 32 was obtained in the direction parallel to the die upset press direction and curve 34 in the direction transverse thereto and thus parallel to the direction of material flow. It is seen that this die upset practice produced greater anisotropy than the single hot pressing operation or the extrusion tests. This translates to a $B_r$ of 9.2 kG and an energy produced of 18 MGOe compared with isotropic ribbon values of $B_r=8$ kG and energy product of about 12 MGOe.

EXAMPLE 4

This example illustrates a die upsetting practice similar to Example 3, except a fully dense, hot pressed sample was die upset with pressure applied in the same direction as the original hot press pressure.

Overquenched ribbon fragments of Example 2 were hot pressed under argon in a heated die, like that depicted in FIG. 1, at a maximum temperature of 760° C. and pressure of 15 kpsi. A ⅜ inch cylindrical body, 100 percent dense, was formed. This hot pressed piece was sanded to a smaller diameter (less than about 1 cm) and die upset in the same diameter cavity in a direction parallel to the first press direction. The die upset operation was conducted at a maximum temperature of 750° C. and a pressure of 12 kpsi. The sample was cooled in the die.

A cubic specimen was machined from the die upset body and its magnetic properties measured in a vibrating sample magnetometer parallel and transverse to the die upset press direction as in the above example. Second quadrant, room temperature, $4\pi KM$ versus H plots for these two directions are depicted in FIG. 7. Curve 36 was obtained in the direction parallel to the die upset press directions and curve 38 in the direction transverse thereto. It is seen that this practice of hot pressing followed by die upsetting in the same direction produced greater anisotropy than was obtained in any of the previous samples. It is seen in FIG. 7 that in the preferred direction of magnetization (curve 36), the remnant magnetization was greater than 11 kG, while the intrinsic coercivity was still greater than 7 kOe. The maximum energy product of this sample was 27 MGOe.

It is believed that still greater alignment can be obtained by a practice that provides greater plastic flow at elevated temperature. One may define an alignment factor by $(B_r)_{parallel}/(B_r)_{perpendicular}$ where $B_r$ is residual induction (at $H=0$) measured parallel to and perpendicular to, respectively, the press direction. An alignment factor of 2.46 was obtained in Example 4. An alignment factor of 1.32 has been achieved by die upsetting (like in Example 3). An alignment factor of 1.18 has been achieved for extrusion (like in Example 2).

My practice of high temperature consolidation and plastic flow can be viewed as a strain-anneal process. This process produces magnetic alignment of the grains of the workpiece and grain growth. However, if the grain growth is excessive, coercivity is decreased. Therefore, consideration (and probably trial and error testing) must be given to the grain size of the starting material in conjunction with the time that the material is at a temperature at which grain growth can occur. If, as is preferred, the starting material is overquenched, the workpiece can be held at a relatively high temperature for a longer time because some grain growth is desired. If one starts with near optimal grain size material, the hot working must be rapid and subsequent cooling prompt to retard excessive grain growth. For example, I have carried out hot pressing experiments on neodymium-iron-boron-melt spun compositions that have been optimally quenched to produce optimal grain size for achieving the highest magnetic product. During such hot pressing, the material was over 700° C. for more than five minutes. The material was held too long at such temperature because the coercivity was always reduced although not completely eliminated. Therefore, optimal benefits were not obtained.

I also conducted hot pressing experiments on annealed ingot that had a homogenized, large grain microstructure. When magnetized, such ingots contained very low coercivity, less than 500 Oersted. My hot pressing strain-anneal practice produced a significant directional dependence of $B_r$ in the ingot samples, but no coercivity increase. It had been hoped that the strain-anneal practice would induce recrystallization in the ingot, which would allow for development of the optimal grain size. The failure to obtain a coercivity increase in these experiments indicates that the strain-anneal practice is not beneficially applicable to such materials.

Thus, my high temperature-high pressure consolidation and hot working of suitable, transition metal, rare earth metal, boron compositions yields magnetically anisotropic product of excellent permanent magnet properties. For purposes of illustration, the practice of my invention has been described, using specific composition of neodymium, iron and boron. However, other materials may be substituted or present in suitably small amounts. Praseodymium may be substituted for neodymium or used in combination with it. Other rare earth metals may be used with neodymium and/or praseodymium. Likewise, other metals, such as cobalt, nickel, manganese and chromium, in suitably small amounts, may be used in combination with iron. The preferred compositional ranges are described above, as well as the essential tetragonal crystal phase.

In many applications, my hot working practice will produce an iron-neodymium-boron magnet to final shape, and little, if any, finish grinding or machining is required.

While my invention has been described in terms of preferred embodiments thereof, it will be appreciated that other embodiments could readily be adapted by those skilled in the art. Accordingly, the scope of my invention is to be considered limited only by the following claims.

The embodiments of the invention in which an exclusive property or privilege is claimed are defined as follows:

1. A method of making an iron-rare earth metal pemanent magnet comprising hot pressing magnetically isotropic particles of an amorphous or finely crystalline material having a grain size less than about 500 nanometers and comprising, on an atomic percent basis, 50 to 90 percent of transition metal, at least 60 percent of which is iron, 10 to 50 percent of rare earth metal, at least 60 percent of the total of which is neodymium and/or praseodymium, and at least one percent boron, at an elevated temperature and pressure for a time sufficient to consolidate the patticulate material into a fully densified body and cooling the body, whereby the resulting hot pressed body is magnetically anisotropic and has a coercivity of 1,000 Oersteds or greater at room temperature.

2. A method of making an iron-rare earth metal permanent magnet comprising hot pressing magnetically isotropic particles of an amorphous or finely crystalline material having a grain size less than about 500 nanometers and comprising, on an atomic percent basis, 50 to 90 percent iron, 10 to 50 percent neodymium and/or preaseodymium, and at least one percent boron, at an elevated temperature above 700° C. and pressure for a time sufficient to consolidate the particulate material into a fully densified body and cooling the body, whereby the resultant hot pressed body is magnetically anisotropic and has a coercivity of 1,000 Oersteds or greater at room temperature.

3. A method of making an anisotropic iron-rare earth metal permanent magnet comprising hot pressing and hot working magnetically isotropic particles of an amorphous to finely crystalline solid material having a grain size les sthan aobut 500 nanometers and comprising, on an atomic percent basis, 50 to 90 percent of transition metal, at least 60 percent of the total transition metal being iron, 10 to 50 percent of rare earth metal, at least 60 percent of the total of which is neodymium and/or praseodymium, and at least oen percent boron, to produce a fully densified, plastically defrrmed body having a fine grain microstructure in which the grain size is no greater than about 500 nanometers nad cooling the body, the duration of hot working and rate of cooling being such that the resultant body is magnetically anisotropic and has a coercivity of 1,000 Oersteds or greater at room temperature.

4. A method of making an anisotropic iron-rate earth metal permanent magnet comprising hot pressing and hot working magnetically isotropic particles of an amorphous to finely crystalline solid material having a grain size less than about 500 nanometers and comprising, on an atomic percent basis, 50 to 90 percent iron, 10 to 50 percent neodymium and/or praseodymium, and at least one percent boron, to produce a fully densified, plastically deformed body having a fine grain microstructure in which the grain size is greater than about 500 nanometers and cooling the body, the duration of hot working and rate of cooling being such that the resultant body is magnetically anisotropic and has a coercivity of 1,000 Oersteds or greater at room temperature.

5. A method of making an anisotropic iron-rate earth metal permanent magnet comprising quenching a molten mixture comprising, on an atomic percent basis, 50 to 90 percent iron, 10 to 50 percent neodymium and/or praaseodymium, and at least one percent boron, at a rate to form magnetically isotropic particles having a grain size up to about 500 nanometers, hot pressing the magnetically isotropic particles at an elevated temperature and pressure to consolidate them into a body, hot working the body to cause plastic flow of at least a portion thereof and to form a fine grained, crystalline microstructure having a grain size no greater than about 500 naometers, and cooling the body, whereby the resulting body is fully densified, magnetically anisotropic and has a coercivity of 1,000 Oersteds or greater at room temperature.

6. A method of making an anisotropic iron-rare earth metal permanent magnet comprising quenching a molten mixture comprising, on an atomic percent basis, 50 to 90 percent of transition metal, at least 60 percent of the total transition metal being iron, 10 to 50 percent of rare earth metal, at least 60 percent of the total of which is neodymium and/or praseodymium, and at least one percent boron, at a rate to form magnetically isotropic particles having a grain size up to about 500 nanometers, hot working the particles to form a fully densified body, to cause plastic flow of at least a portion of the body and to form a fine grained, crystalline microstructure having a grain size no greater than about 500 nanometers, and cooling the body, whereby the resulting body is magnetically anisotropic and has a coercivity of 1,000 Oersteds or greater at room temperature.

7. A method of making an anisotropic iron-rare earth metal permanent magnet comprising quenching a molten mixture comprising, on an atomic percent basis, 50 to 90 percent of transition metal, at least 60 percent of the total transition metal being iron, 10 to 50 percent of rare earth metal, at least 6 percent of the total of which is neodymium and/or praseodymium, and at least one percent boron, at a rate to form an overquenched, thin, solid, magnetically isotropic ribbon material having a grain size up to about 500 naometers, hot working magnetically isotropic pieces of the ribbon material at an elevated temperature and pressure to consolidate the pieces into a fully densified body, to cause plastic flow of at least a portion of the body and to form a fine grained, crystalline microstruture having a grain size no greater than about 500 nanometers, and cooling the body, whereby the resulting body is magnetically anisotropic and has a coercivity of 1,000 Oersteds or greater at room temperature.

* * * * *